US008801540B2

(12) United States Patent
Hebreo et al.

(10) Patent No.: US 8,801,540 B2
(45) Date of Patent: Aug. 12, 2014

(54) GOLF CLUB HEAD

(75) Inventors: Jonathan Hebreo, San Diego, CA (US); Marni Ines, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 153 days.

(21) Appl. No.: 13/558,433

(22) Filed: Jul. 26, 2012

(65) Prior Publication Data

US 2014/0031144 A1 Jan. 30, 2014

(51) Int. Cl.
*A63B 53/04* (2006.01)

(52) U.S. Cl.
USPC ..... 473/329; 473/332; 473/349; 473/350

(58) Field of Classification Search
CPC ..... A63B 53/047; A63B 53/0475; A63B 2053/0425; A63B 53/0429; A63B 53/042; A63B 53/0454; A63B 2209/14
USPC ..... 473/324–350, 287–292
See application file for complete search history.

(56) References Cited

U.S. PATENT DOCUMENTS 4,740,345 A * 4/1988 Nagasaki et al. ..... 264/257
5,586,947 A * 12/1996 Hutin ..... 473/324
5,613,917 A 3/1997 Kobayashi et al.
5,658,208 A 8/1997 Shimasaki
5,749,794 A 5/1998 Kobayashi et al.
5,749,795 A * 5/1998 Schmidt et al. ..... 473/350
5,766,091 A 6/1998 Humphrey et al.
5,774,970 A 7/1998 Huang
5,863,261 A * 1/1999 Eggiman ..... 473/329
6,030,293 A * 2/2000 Takeda ..... 473/334
6,200,228 B1 3/2001 Takeda
6,743,117 B2 6/2004 Gilbert
6,835,144 B2 12/2004 Best
6,872,153 B2 3/2005 Gilbert et al.
6,964,620 B2 11/2005 Gilbert et al.
7,281,991 B2 10/2007 Gilbert et al.
7,303,489 B2 12/2007 Gilbert et al.
8,267,807 B2 * 9/2012 Takechi et al. ..... 473/332
2004/0242339 A1 * 12/2004 Gilbert et al. ..... 473/291

* cited by examiner

*Primary Examiner* — Sebastiano Passaniti
(74) *Attorney, Agent, or Firm* — Troy R. Lester

(57) ABSTRACT

A golf club iron having a thin front face which is supported by a biasly connected insert that is inserted into a perimeter groove defined in the body of the club which gives the thin front face added support. The insert has a flange about its perimeter, and the perimeter groove has an opening ledge. The insert flange is slightly larger in thickness than the ledge and when the insert is biasly pushed into the perimeter groove a mechanical connection is created between the insert and the body of the club.

6 Claims, 1 Drawing Sheet

GOLF CLUB HEAD

FIELD OF THE INVENTION

The present invention relates generally to an iron-type golf club having a cavity filled with a reinforcing back member. The back member being attached mechanically to the golf club head by pressing the edges of the back member into a groove around the perimeter of the cavity.

BACKGROUND OF THE INVENTION

The desire for perimeter weighting in a golf club iron is well known in the art. This desire stems from the fact that as the mass of the iron is distributed towards the perimeter, the trajectory of the hit ball becomes more consistent for off-center hits away from the sweet spot of the golf club face or hitting surface. Consequently, many modern golf club irons have a "cavity back" design. These clubs are made by removing the weight from the center of the club head and redistributing it along the bottom, the top, the heel and toe portions of the club head. Club heads of the latter type have enjoyed considerable success since they effectively enlarge the "sweet spot" of the club head.

The "sweet spot" of the club head is generally regarded to be that area on the striking face of the club head immediately surrounding the center of gravity of the club head. By enlarging the sweet spot, perimeter weighted club heads allow golfers of all abilities to realize improved results over conventional club heads when the golfer fails to strike the golf ball in line with the center of gravity of the club head. These improved results translate into "mis-hit" shots that travel farther and straighter than they would if struck with a club having another conventional club head design. The weight saved by creating a rear cavity in the iron, is re-distributed to the perimeter of the golf club head. The greater the volume of the cavity, the larger the mass of metal that can be redistributed into the perimeter of the golf club head. However, if the thickness of the face hitting surface is reduced to an extent where it becomes too thin, the strength of the face becomes too low to resist the force of the ball hitting the face. Thus, it would be desirable to find a way to further increase the volume of the cavity without causing the face to fail upon impact with the ball.

As discussed, it is desirable to provide a means for creating a thin faced club head having a high COR for increased distance in each iron of a set of golf club irons, or at least the longer irons. However, a limiting parameter is when the thickness of the face becomes too thin, it adversely effects the strength of the face. The well-known cure is to support the face with a low-density insert, preferably one placed into a rear cavity opening. The present invention utilizes a rear insert to provide strength for the front face and reinforce the face during impact. The present invention provides a solution for providing stiffness to a frame that has had weight removed from the peripheral.

SUMMARY OF THE INVENTION

The present invention overcomes the disadvantages of the prior art by providing a rear cavity insert, which has a flange about the perimeter of the insert which deforms when biasly forced by mechanical tension into a perimeter groove which is defined in the peripheral of the club body. The thin front face of the club body is therein reinforced and has an additional measure of stiffness provided to it.

The rear cavity insert has a flat surface that is juxtaposed against the flat back surface of the front face. The deformation of the flange, which has a thickness greater than the size of the ledge within the perimeter groove, allows the construction to be mechanically locked. The rear cavity insert is preferably made from a deformable material, but a metal is preferred.

DETAILED DESCRIPTION OF THE PREFERRED EMBODIMENTS

Figure 1:
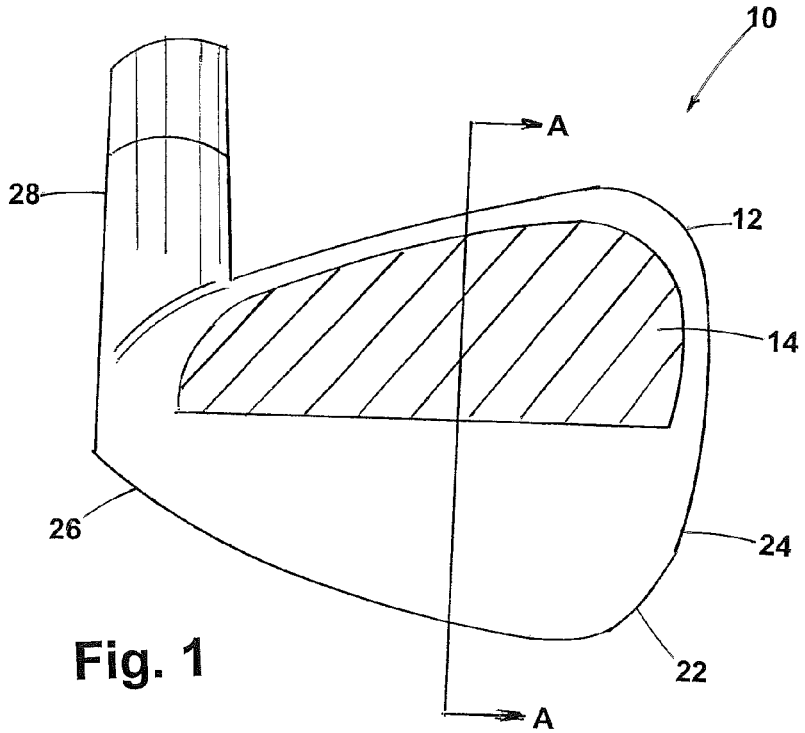
FIG. 1 is a back view of a golf club iron-type head according to an embodiment of the invention.
Figure 2:
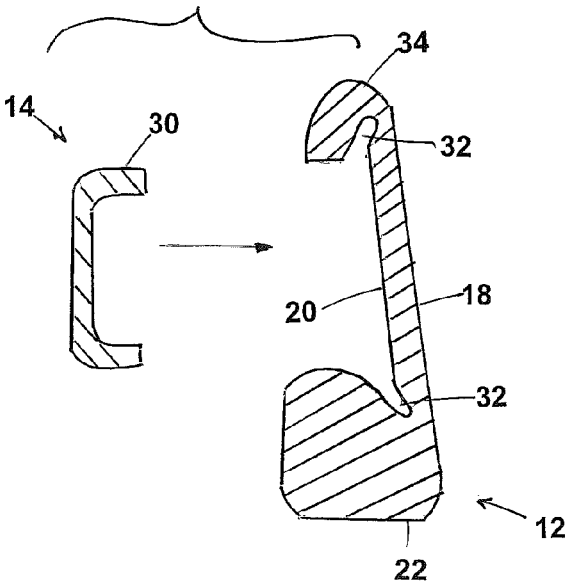
FIG. 2 is an expanded sectional view along line A-A of FIG. 1 depicting the back cavity member and club head prior to the back cavity member being deformed upon insertion into the club head.
Figure 3:
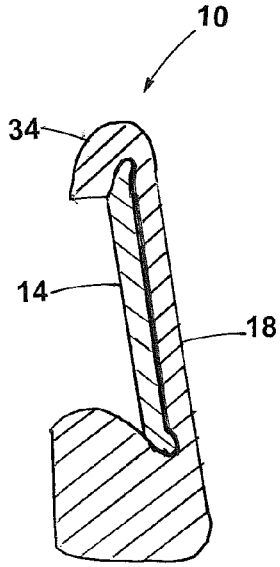
FIG. 3 is a section view taken along the line A-A of FIG. 1 showing the club head with back cavity member inserted into the perimeter groove.

Hereinafter is described a first embodiment of the invention with references to FIGS. 1 to 3. As shown in FIGS. 1 to 3, reference numeral 10 designates a cavity back club head, having a body 12 while reference number 14 designates a reinforcing rear cavity insert that is mechanically inserted into a perimeter groove 16 that is defined in the peripheral area 34 of the club head body 12. FIGS. 2 and 3, which are section views taken along the line A-A of FIG. 1, show the club head 10 consisting of a front face 18, a back surface 20 of the front face, a sole portion 22, a toe portion 24, a heel portion 26, and a hosel portion 28. FIG. 2 is an expanded view, and shows the rear cavity insert 14 prior to being deformed upon insertion into the perimeter groove 16. The rear cavity insert 14 has a deformable flange 30 about its perimeter which deforms upon being biasly inserted into a ledge 32 defined in the perimeter groove 16 of the club head. The thickness of the flange 30 is slightly thicker than the ledge 32, therein allowing for a friction-fitted mechanical connection between the insert 14 and the body 12 of the club 10.

FIG. 2 shows the rear cavity insert 14 in a juxtaposed position against the back face 16 of the body 12 therein reinforcing the thin hitting surface of the club head and providing increased stiffness.

The present invention can be used on any iron-type golf club that has a back cavity. The improvements provided by the present invention are numerous but may be seen in three primary aspects. First, the rear cavity insert 14 provides wall support to a thin face. Secondly, because the invention requires the perimeter groove 16 to be partially filled by the flange 30 of the insert 14, weight is removed allowing it to be placed in more desirable locations, such as in the sole portion 18. And thirdly, since the perimeter groove 16 of the cavity reduces the stiffness of the frame of the club head, the flange 30 of the rear cavity insert 14 fills the open end, whereupon a tubular structure is formed giving the frame back some measure of stiffness.

The present invention may be manufactured by a process which may be either forged or a cast. The body 12 is generally cast out of stainless steel. In a forged embodiment, the periphery can be cast or forged and the front face can be made of rolled, stamped or forged high strength steel, such as stainless steel 455 and more preferably stainless steel 465. Using high strength steel permits the front face to be thinned-down. The rear cavity insert 14 may be made from a solid deformable material, preferably a metal. Light metals such as titanium or aluminum, or alloys thereof provide excellent vibration and dampening qualities. Heavier metals used may be tungsten or nickel tungsten alloy. The metal employed in the insert should be less than 0.20 inches thick, preferably less than 0.15 inches and most preferably less than 0.10 inch. One embodiment prefers that the back surface of the front face have a bonding tape 36, such as an acrylic foam tape with a thickness ranging from 0.016 to 0.120 inches.

While it is apparent that the illustrative embodiments of the invention herein disclosed fulfill the objectives stated above, it will be appreciated that numerous modifications and other embodiments may be devised by those skilled in the art. Therefore, it will be appreciated that the appended claims are intended to cover all such modifications and embodiments which come within the spirit and scope of the present invention.

What is claimed is:

1. A golf club head comprising:

a body including a thin front face;

a perimeter weighted periphery surrounding the front face to define a rear cavity;

a perimeter groove defined in the perimeter weighted periphery wherein a ledge is defined therein;

a rear cavity insert having a deformable flange about the perimeter of the insert, wherein, the rear cavity insert is biasedly juxtaposed against a portion of a back surface of the front face, and the flange is deformed by being pushed into the ledge of the perimeter groove to substantially fill the perimeter groove, wherein the rear cavity insert is made of a solid deformable metal, wherein the thickness of the deformable metal is less than 0.2 inch, and wherein the back surface of the front face has a bonding tape disposed between the back surface and the rear cavity insert.

2. The golf club head according to claim 1, wherein the rear cavity insert metal is tungsten or a nickel tungsten alloy.

3. The golf club head according to claim 1, wherein the thickness of the flange is slightly larger than the thickness of the ledge of the perimeter groove.

4. The golf club head according to claim 1, wherein the thickness of the deformable metal is less than 0.15 inch.

5. The golf club head according to claim 1, wherein the thickness of the deformable metal is less than 0.10 inch.

6. The golf club head according to claim 1, wherein the bonding tape is an acrylic foam tape having a thickness from 0.016 to 0.120 inch.

* * * * *